US011735881B2

(12) United States Patent
Gao

(10) Patent No.: US 11,735,881 B2
(45) Date of Patent: Aug. 22, 2023

(54) MULTI-STATION ROTATING TERMINAL CRIMPING MACHINE HEAD

(71) Applicant: SHENZHEN CITY LINQUAN TECHNOLOGY CO., LTD, Shenzhen (CN)

(72) Inventor: Donglin Gao, Zhoukou (CN)

(73) Assignee: SHENZHEN CITY LINQUAN TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/746,991

(22) Filed: May 18, 2022

(65) Prior Publication Data

US 2022/0278493 A1 Sep. 1, 2022

Related U.S. Application Data

(63) Continuation of application No. PCT/CN2022/077734, filed on Feb. 24, 2022.

(30) Foreign Application Priority Data

Feb. 24, 2021 (CN) ..... 202110206798.5

(51) Int. Cl.
*H01R 43/048* (2006.01)
*H01R 43/058* (2006.01)
(Continued)

(52) U.S. Cl.
CPC ..... *H01R 43/048* (2013.01); *H01R 43/058* (2013.01); *H01R 43/0585* (2013.01);
(Continued)

(58) Field of Classification Search
CPC ..... Y10T 29/53235; Y10T 29/53187; H01R 43/055; H01R 43/058; H01R 43/0585;
(Continued)

(56) References Cited

U.S. PATENT DOCUMENTS 5,027,636 A * 7/1991 Dassance ..... H01R 43/055 29/863
5,535,497 A 7/1996 Huang
2014/0219854 A1* 8/2014 Matsen ..... B21D 21/00 419/29

FOREIGN PATENT DOCUMENTS

CN 2672925 Y 1/2005
CN 204793556 U 11/2015
(Continued)

OTHER PUBLICATIONS

Machine Translation of CN 205869183, Jan. 2023. (Year: 2023).*

*Primary Examiner* — A. Dexter Tugbang

(57) ABSTRACT

A multi-station rotating terminal crimping machine head is provided, the multi-station rotating terminal crimping machine head includes a machine table, a supporting device, a punching head, a rotating seat, a plurality of station seats, a first driving motor, and a first right-angle speed reducer. The supporting device is fixedly disposed on the machine table. The punching head is disposed on the supporting device. The rotating seat is rotatably disposed on the machine table. The plurality of the station seats are disposed on the rotating seat and rotate along with the rotating seat. The first driving motor and the first right-angle speed reducer are disposed on the machine table.

15 Claims, 6 Drawing Sheets

(51) Int. Cl.

| | |
|---|---|
| *B21D 22/02* | (2006.01) |
| *B21D 22/06* | (2006.01) |
| *H01R 43/055* | (2006.01) |
| *B21D 22/00* | (2006.01) |

(52) U.S. Cl.
CPC ..... *B21D 22/00* (2013.01); *B21D 22/02* (2013.01); *B21D 22/06* (2013.01); *H01R 43/055* (2013.01); *Y10T 29/53187* (2015.01); *Y10T 29/53235* (2015.01)

(58) Field of Classification Search
CPC ..... H01R 43/048; B21D 21/00; B21D 21/02; B21D 21/06
See application file for complete search history.

(56) References Cited

FOREIGN PATENT DOCUMENTS

| | | | | | |
|---|---|---|---|---|---|
| CN | 205869183 | U | | 1/2017 | |
| CN | 206022858 | U | | 3/2017 | |
| CN | 207265390 | U | | 4/2018 | |
| CN | 210111256 | U | | 2/2020 | |
| CN | 211029718 | U | | 7/2020 | |
| CN | 211428546 | U | | 9/2020 | |
| JP | 2014123546 | A | * | 7/2014 | ..... G01F 23/38 |

* cited by examiner

MULTI-STATION ROTATING TERMINAL CRIMPING MACHINE HEAD

TECHNICAL FIELD

The present disclosure relates to a terminal crimping machine head, and in particular to a multi-station rotating terminal crimping machine head.

BACKGROUND

Generally, a present terminal crimping machine head may only punch a mold, a terminal, or the like which are fixed on a machine table. During a punching process, due to a fact that wire changing and other operations are needed, punching waiting time of the present terminal crimping machine is long, and punching efficiency of which is also low.

SUMMARY

In order to solve above defects in prior art, the present disclosure provides a multi-station rotating terminal crimping machine head.

The present disclosure provides a technical scheme of the multi-station rotating terminal crimping machine head where the multi-station rotating terminal crimping machine head includes a machine table, a supporting device, a punching head, a rotating seat, a plurality of station seats, a first driving motor, and a first right-angle speed reducer. The supporting device is fixedly disposed on the machine table. The punching head is disposed on the supporting device. The rotating seat is rotatably disposed on the machine table. The plurality of the station seats are disposed on the rotating seat and rotate along with the rotating seat. The first driving motor and the first right-angle speed reducer are disposed on the machine table, and the first driving motor and the first right-angle speed reducer are configured to drive the rotating seat to rotate.

Furthermore, the machine table includes a mounting table and a U-shaped supporting seat. The U-shaped supporting seat is fixedly disposed at an end of the mounting table. The U-shaped supporting seat includes a first supporting seat, a base, and a second supporting seat. The first supporting seat is vertically and fixedly connected to the end of the mounting table. The base is vertically and fixedly connected to a bottom end of the first supporting seat. The second supporting seat is vertically and fixedly connected to a second end of the base. The rotating seat is rotatably disposed between the first supporting seat and the second supporting seat. The first driving motor and the first right-angle speed reducer are fixedly disposed on the first supporting seat. An output end of the first driving motor is connected to an input end of the first right-angle speed reducer. The first right-angle speed reducer drives the rotating seat to rotate. A first side of the rotating seat is fixedly connected with an output shaft of the first right-angle speed reducer. A second side of the rotating seat is rotatably connected to the second supporting seat.

Furthermore, the plurality of the station seats are disposed at equal intervals on a periphery of the rotating seat. The multi-station rotating terminal crimping machine head further includes an air cylinder. The air cylinder is fixedly disposed on the first supporting seat, and a telescopic positioning rod is disposed on the air cylinder. A plurality of positioning holes are defined on the rotating seat, and the plurality of the positioning holes are configured for the telescopic positioning rod to be inserted into when the plurality of the station seats rotate to face the punching head.

Furthermore, the punching head includes a second driving motor, a second right-angle speed reducer, a first sliding rail, a second sliding rail, a sliding block, and a punching component. The second driving motor is fixedly disposed on the supporting device. The second right-angle speed reducer is connected to the second driving motor. The first sliding rail is fixedly disposed on the supporting device. The second sliding rail is fixedly disposed on the supporting device and is opposite to the first sliding rail. The sliding block is slidably disposed between the first sliding rail and the second sliding rail. The punching component is disposed at a bottom of the sliding block and moves along with the sliding block. An output end of the second driving motor is connected to an input end of the second right-angle speed reducer. A turntable is disposed on an output shaft of the second right-angle speed reducer, and the turntable rotates along with the output shaft of the second right-angle speed reducer. An eccentric shaft is eccentrically disposed on the turntable, and a driving disc is rotatably sleeved on the eccentric shaft. A circular racetrack-shaped driving cavity for accommodating the driving disc is disposed on the sliding block. The driving disc rotates in the driving cavity and drives the sliding block to slide along the first sliding rail and the second sliding rail.

Furthermore, the first sliding rail includes a first vertical guide rail, a first V-shaped sliding groove, a plurality of first roller pins, and a plurality of second roller pins. The first V-shaped sliding groove is defined on an inner side surface of the first vertical guide rail. The plurality of the first roller pins are rotatably disposed on a first side wall of the first V-shaped sliding groove. The plurality of the second roller pins are rotatably disposed on a second side wall of the first V-shaped sliding groove.

The second sliding rail includes a second vertical guide rail, a second V-shaped sliding groove, a plurality of third roller pins, and a plurality of fourth roller pins. The second V-shaped sliding groove is defined on an inner side surface of the second vertical guide rail. The plurality of the third roller pins are rotatably disposed on a first side wall of the second V-shaped sliding groove. The plurality of the fourth roller pins are rotatably disposed on a second side wall of the second V-shaped sliding groove.

A first V-shaped flange, slidable in the first V-shaped sliding groove, is disposed on a first side of the sliding block. A second V-shaped flange, slidable in the second V-shaped sliding groove, is disposed on a second side of the sliding block.

Furthermore, the sliding block includes a body, a first connecting portion, a second connecting portion, and a mounting position. The first connecting portion is fixedly disposed on a first side of a bottom of the body and protrudes out of the bottom of the body. The second connecting portion is fixedly disposed on a second side of the bottom of the body and protrudes out of the bottom of the body. The mounting position is configured to fix and install the punching component and further disposed between the first connecting portion and the second connecting portion.

Furthermore, the punching component includes a punching head component and a connecting component. The connecting component connects the punching head component with the sliding block. A first vertical sliding groove is defined on a first side of the connecting component, and the first connecting portion is partially embedded in the first vertical sliding groove and further slidably connected with the first vertical sliding groove. A second vertical sliding groove is defined on a second side of the connecting component, and the second connecting portion is partially embedded in the second vertical sliding groove and further slidably connected with the second vertical sliding groove. A screw rod is disposed on the body, the screw rod vertically penetrates through the body and is screwed with the connecting component, and the screw rod is rotated to drive the connecting component to slide relative to the sliding block.

A nut is fixedly disposed at a top end of the screw rod, and a polygonal hole is defined on the nut or the nut is a polygonal nut.

A through hole is defined on the body, and the screw rod vertically penetrates through the through hole. A connecting hole is defined on an outer side surface of the body, and the connecting hole is communicated with the through hole. A crimping block is disposed in the connecting hole, and the crimping block is configured to compress the screw rod. The crimping block is connected to the body through a bolt.

Furthermore, the punching head component at least includes a pressure sensor and a first punching head. The pressure sensor is fixedly disposed between the first punching head and the connecting component. The first punching head includes a fixing portion, a first clipping block, and a second clipping block. The first clipping block is fixedly disposed on a first side of a bottom of the fixing portion. The second clipping block is fixedly disposed on a second side of the bottom of the fixing portion. A first stop block is disposed on a bottom end of the first clipping block, and the first stop block extends in a direction of the second clipping block. A second stop block is disposed on a bottom end of the second clipping block, and the second stop block extends in a direction of the first clipping block. The first clipping block, the second clipping block, the first stop block, and the second stop block are clipped to form a fixing position for mounting and fixing a mold.

Furthermore, the punching head component further includes a vertical crimping rod. The crimping rod is fixedly connected to the connecting component, and the crimping rod is connected to the connecting component through a connecting rod. At least one fixing hole is defined on the connecting rod, and the crimping rod penetrates through the at least one fixing hole and is further fixedly connected with the at least one fixing hole.

The punching head component further includes a second punching head, and the second punching head is detachably connected to the first punching head. The second punching head includes a clipping block and a connecting column. The clipping block is fixedly clipped into the fixing position. The connecting column is fixedly disposed on a middle of a bottom surface of the clipping block and protrudes out of the bottom surface of the clipping block. At least one annular groove is defined on the connecting column and is recessed inwards in the connecting column, or a connecting disc is disposed on a surface of a bottom end of the connecting column.

Furthermore, the supporting device includes a first supporting plate and a second supporting plate. The first supporting plate and the second supporting plate are fixedly connected to the machine table, and the first supporting plate and the second supporting plate are respectively disposed on two sides of the second driving motor. A fixing seat is fixedly disposed between the first supporting plate and the second supporting plate, and the fixing seat is fixedly connected to the first supporting plate and the second supporting plate. The first sliding rail and the second sliding rail are respectively disposed on two sides of the fixing seat, or the first sliding rail and the second sliding rail are respectively disposed on an inner side surface of the first supporting plate and an inner side surface of the second supporting plate.

The fixing seat is disposed between the second right-angle speed reducer and the sliding block. A fixing seat through hole is defined on the fixing seat, and the turntable rotates through the fixing seat through hole.

The multi-station rotating terminal crimping machine head of the present disclosure has following beneficial effects: when using the multi-station rotating terminal crimping machine head, in a process of crimping a terminal, a plurality of molds are respectively installed on the plurality of the station seats. During the punching process, the rotating seat is controlled to rotate and drive the station seats to rotate, and when one of the station seats is rotated to a position directly below the punching head, the punching head is crimped downwards to realize terminal crimping. After punching of the one of the station seats is completed, the rotating seat is continuously rotated, which drives a next one of the station seats to rotate to the position directly below the punching head, and punches the next one of the station seats to achieve continuous and rapid punching, thereby improving production efficiency.

BRIEF DESCRIPTION OF DRAWINGS

The present disclosure is further described below with reference to accompanying drawings and embodiments, in which.

DETAILED DESCRIPTION

In order to make objectives, technical solutions and advantages of the present invention clearer, embodiments of the present disclosure are further described in detail below with reference to accompanying drawings.

Figure 1:
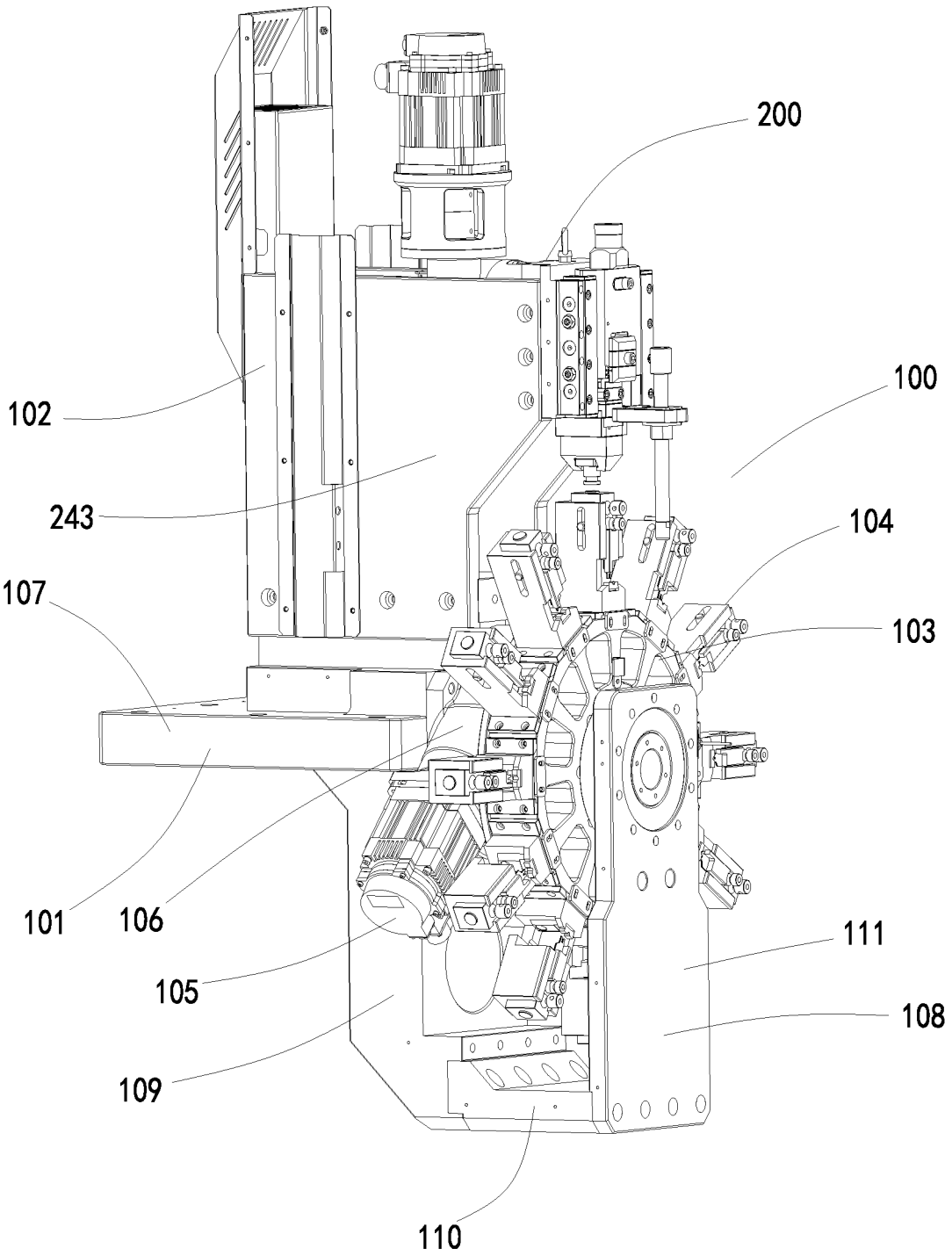
FIG. 1 is a first structural schematic diagram of a multi-station rotating terminal crimping machine head according to the present disclosure.

As shown in FIG. 1, in a first embodiment of a multi-station rotating terminal crimping machine head of the present disclosure, the crimping machine head 100 includes a machine table 101, a supporting device 102, a punching head 200, a rotating seat 103, a plurality of station seats 104, a first driving motor 105, and a first right-angle speed reducer 106. The supporting device 102 is fixedly disposed on the machine table 101. The punching head 200 is disposed on the supporting device 102. The rotating seat 103 is rotatably disposed on the machine table 101. The plurality of the station seats 104 are disposed on the rotating seat 103 and rotate along with the rotating seat 103. The first driving motor 105 and the first right-angle speed reducer 106 are disposed on the machine table 101, and the first driving motor 105 and the first right-angle speed reducer 106 are configured to drive the rotating seat 103 to rotate.

When using the multi-station rotating terminal crimping machine head 100, in a process of crimping a terminal, a plurality of molds are respectively installed on the plurality of the station seats 104. During the punching process, the rotating seat 103 is controlled to rotate and drive the station seats 104 to rotate, and when one of the station seats 104 rotate to a position directly below the punching head 200, the punching head 200 is crimped downwards to realize terminal crimping. After punching of the one of the station seats 104 is completed, the rotating seat 103 is continuously rotated, which drives a next one of the station seats 104 to rotate to the position directly below the punching head 200, and punches the next one of the station seats 104 to achieve continuous and rapid punching, thereby improving production efficiency.

Specifically, the machine table 101 includes a mounting table 107 and a U-shaped supporting seat 108. The U-shaped supporting seat 108 is fixedly disposed at an end of the mounting table 107. The U-shaped supporting seat 108 includes a first supporting seat 109, a base 110, and a second supporting seat 111. The first supporting seat 109 is vertically and fixedly connected to the end of the mounting table 107. The base 110 is vertically and fixedly connected to a bottom end of the first supporting seat 109. The second supporting seat 111 is vertically and fixedly connected to a second end of the base 110. The rotating seat 103 is rotatably disposed between the first supporting seat 109 and the second supporting seat 111. The first driving motor 105 and the first right-angle speed reducer 106 are fixedly disposed on the first supporting seat 109. An output end of the first driving motor 105 is connected to an input end of the first right-angle speed reducer 106. The first right-angle speed reducer 106 drives the rotating seat 103 to rotate. A first side of the rotating seat 103 is fixedly connected with an output shaft of the first right-angle speed reducer 106. A second side of the rotating seat 103 is rotatably connected to the second supporting seat 111.

Figure 2:
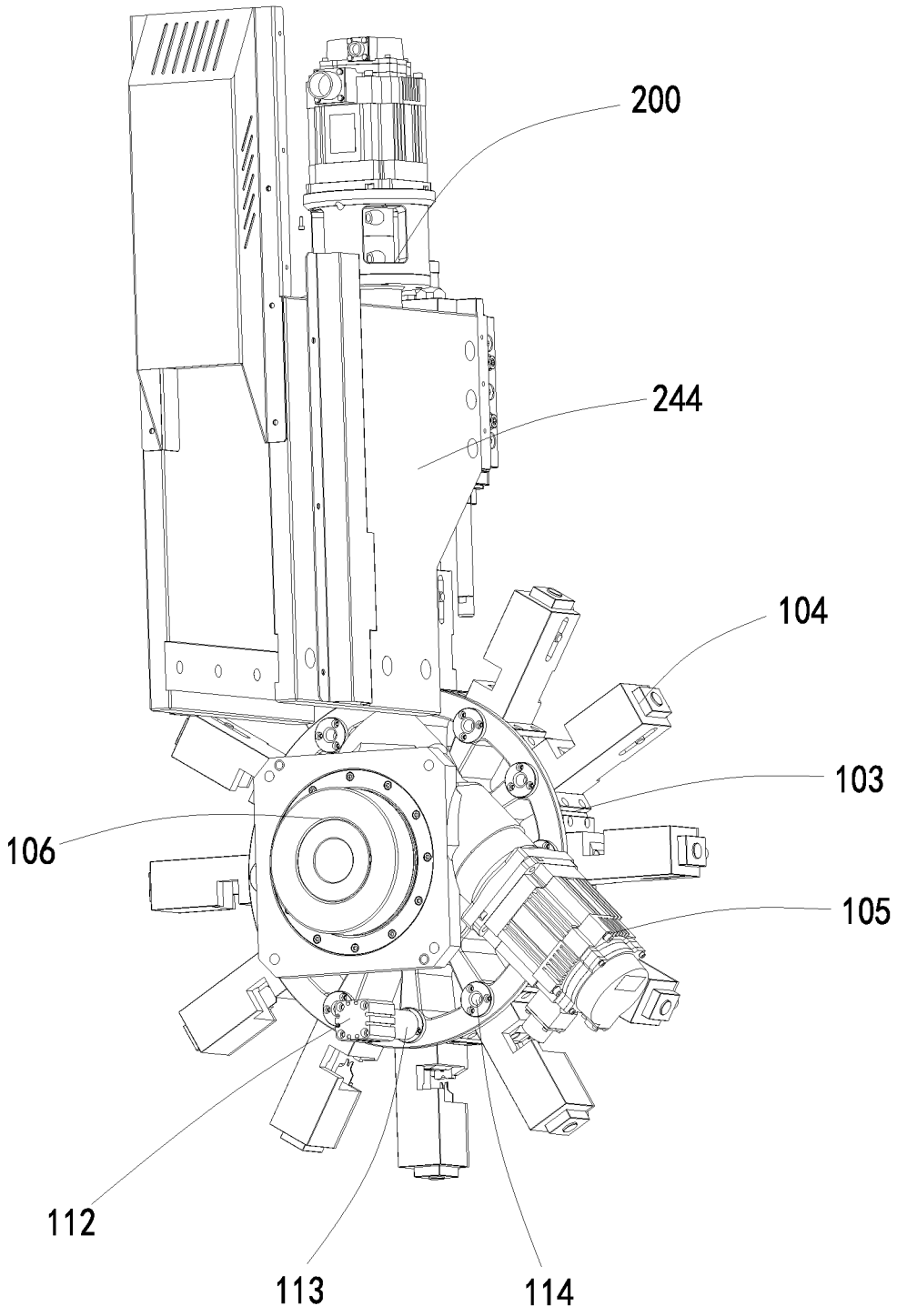
FIG. 2 is a second structural schematic diagram of the multi-station rotating terminal crimping machine head according to the present disclosure.

In order to achieve a stable supporting effect on the rotating seat 103, as shown in FIG. 2, the plurality of the station seats 104 are disposed at equal intervals on a periphery of the rotating seat 103. The multi-station rotating terminal crimping machine head 100 further includes an air cylinder 112. The air cylinder 112 is fixedly disposed on the first supporting seat 109, and a telescopic positioning rod 113 is disposed on the air cylinder 112. A plurality of positioning holes 114 are defined on the rotating seat 103, and the plurality of the positioning holes 114 are configured for the telescopic positioning rod 113 to be inserted into when the plurality of the station seats 104 rotate to face the punching head 200.

When the rotating seat 103 rotates to the position directly opposite to the punching head 200, the air cylinder 112 is inflated, the telescopic positioning rod 113 on the air cylinder 112 extends into the positioning holes 114, the telescopic positioning rod 113 positions and supports the rotating seat 103, which prevents damage on the rotating seat 103 during the punching process.

Figure 3:
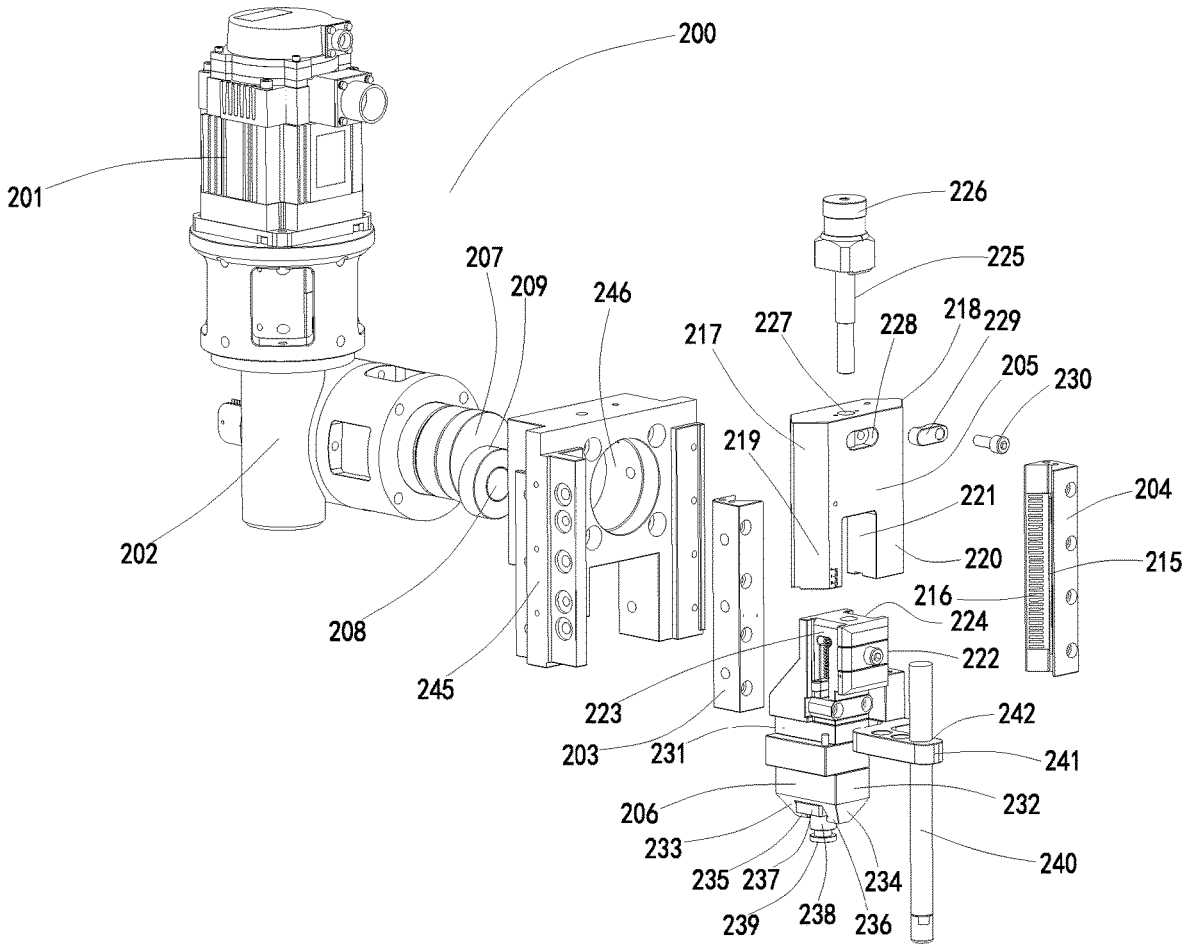
FIG. 3 is a first exploded structural schematic diagram of a punching head of the multi-station rotating terminal crimping machine head according to the present disclosure.
Figure 4:
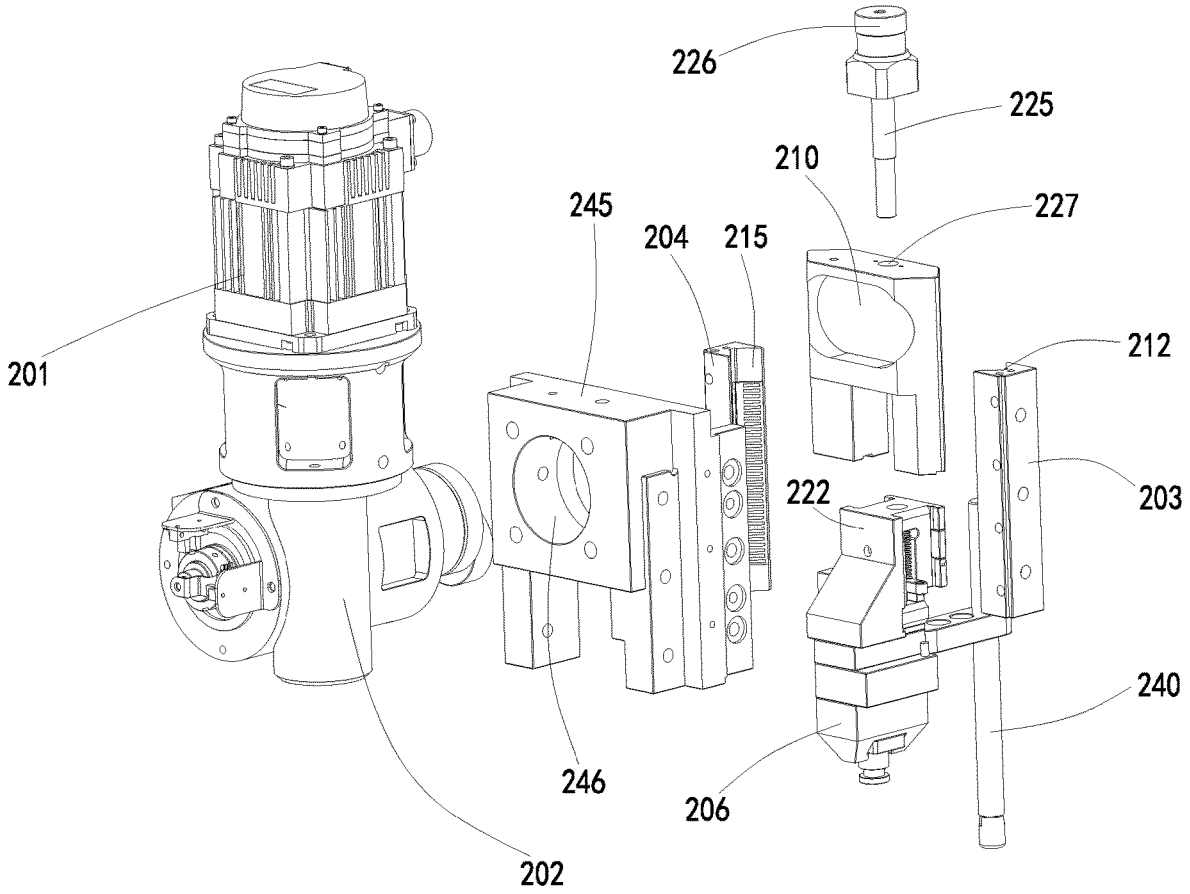
FIG. 4 is a second exploded structural schematic diagram of the punching head of the multi-station rotating terminal crimping machine head according to the present disclosure.
Figure 5:
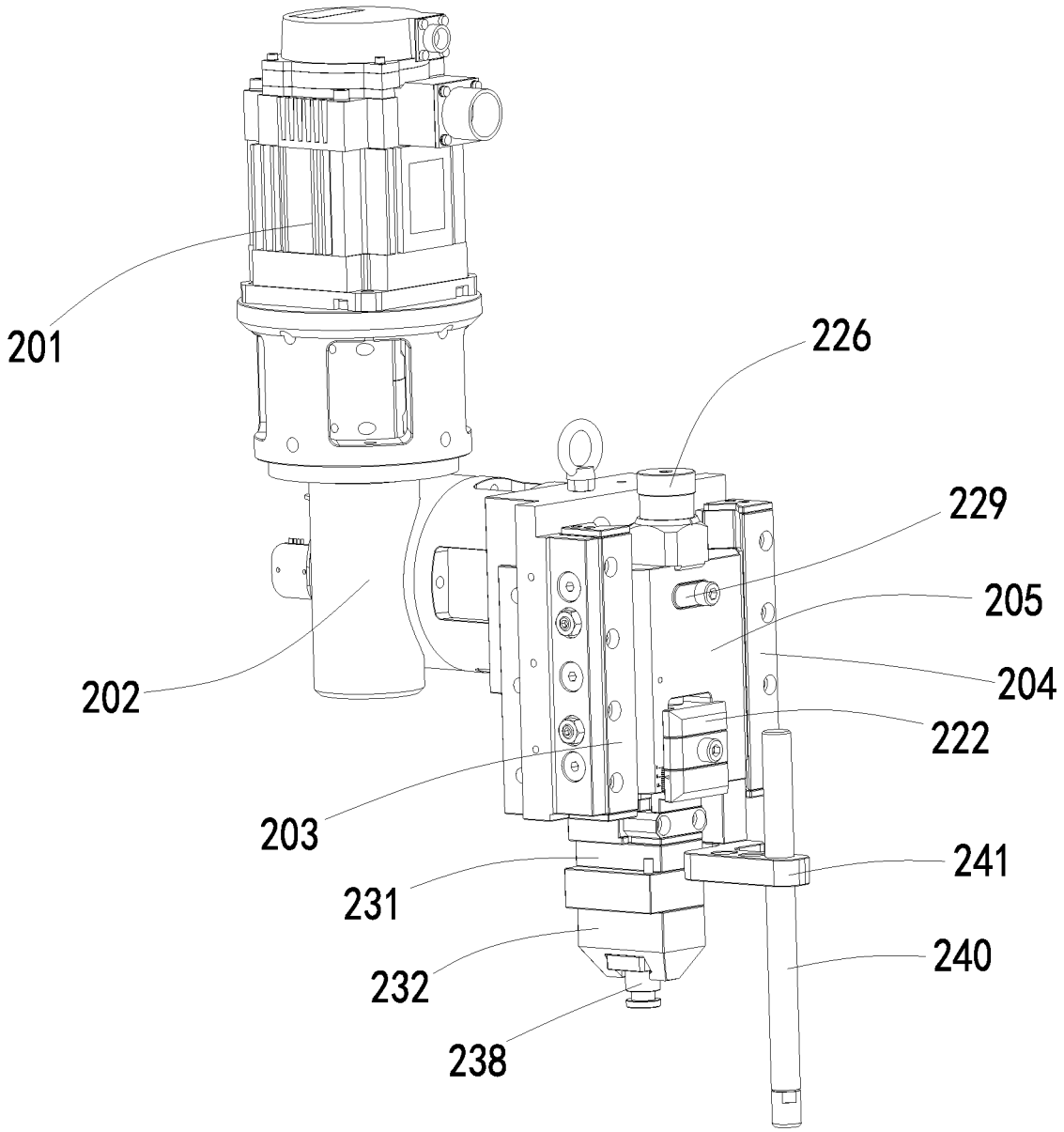
FIG. 5 is a component structural schematic diagram of the punching head of the multi-station rotating terminal crimping machine head according to the present disclosure.

As shown in FIGS. 3-5, the punching head 200 includes a second driving motor 201, a second right-angle speed reducer 202, a first sliding rail 203, a second sliding rail 204, a sliding block 205, and a punching component 206. The second driving motor 201 is fixedly disposed on the supporting device 102. The second right-angle speed reducer 202 is connected to the second driving motor 201. The first sliding rail 203 is fixedly disposed on the supporting device 102. The second sliding rail 204 is fixedly disposed on the supporting device 102 and is opposite to the first sliding rail 203. The sliding block 205 is slidably disposed between the first sliding rail 203 and the second sliding rail 204. The punching component 206 is disposed at a bottom of the sliding block 205 and moves along with the sliding block 205. An output end of the second driving motor 201 is connected to an input end of the second right-angle speed reducer 202. A turntable 207 is disposed on an output shaft of the second right-angle speed reducer 202, and the turntable 207 rotates along with the output shaft of the second right-angle speed reducer 202. An eccentric shaft is eccentrically disposed on the turntable 207, and a driving disc 209 is rotatably sleeved on the eccentric shaft 208. A circular racetrack-shaped driving cavity for accommodating the driving disc 209 is disposed the sliding block 205. The driving disc 209 rotates in the driving cavity 210 and drives the sliding block 205 to slide along the first sliding rail 203 and the second sliding rail 204.

When using the punching head 200, the second driving motor 201 is disposed at an angle same as a sliding direction of the sliding block 205, and then an output of rotating the second driving motor 201 is converted into an output of rotating the output shaft of the second right-angle speed reducer 202 through the second right-angle speed reducer 202. During rotating the output shaft, the output shaft drives the turntable 207 to rotate, the turntable 207 drives the eccentric shaft 208 to rotate, and the eccentric shaft 208 rotates and drives the driving disc 209 to rotate within the driving cavity 210. Since the first sliding rail 203 and the second sliding rail 204 limit the sliding direction of the sliding block 205, in a rotating process of the driving disc 209 in the driving cavity 210, the driving disc 209 pushes the sliding block 205 to reciprocate up and down along the first sliding rail 203 and the second sliding rail 204, and the sliding block 205 drives the punching component 206 to perform terminal crimping in the up-down movement.

Figure 6:
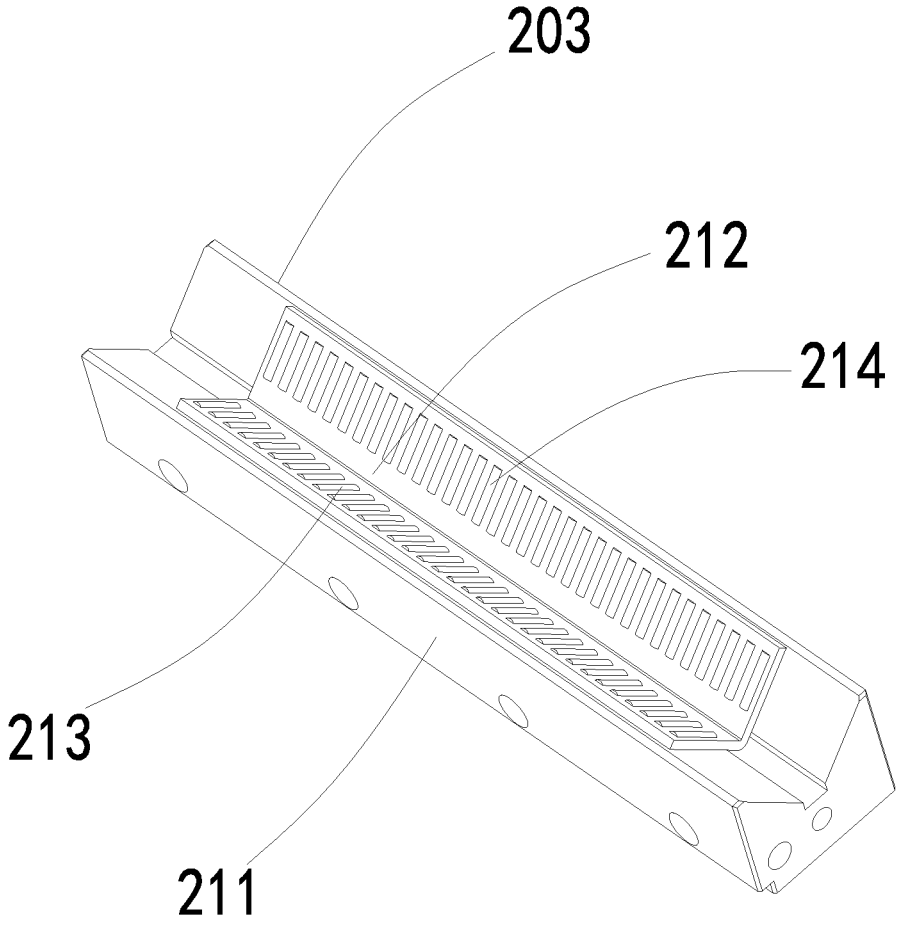
FIG. 6 is a structural schematic diagram of a first sliding rail of the multi-station rotating terminal crimping machine head according to the present disclosure.

Specifically, as shown in FIG. 6, the first sliding rail 203 includes a first vertical guide rail 211, a first V-shaped sliding groove 212, a plurality of first roller pins 213, and a plurality of second roller pins 214. The first V-shaped sliding groove 212 is defined on an inner side surface of the first vertical guide rail 211. The plurality of the first roller pins 213 are rotatably disposed on a first side wall of the first V-shaped sliding groove 212. The plurality of the second roller pins 214 are rotatably disposed on a second side wall of the first V-shaped sliding groove 212. The second sliding rail 204 includes a second vertical guide rail, a second V-shaped sliding groove 215, a plurality of third roller pins 216, and a plurality of fourth roller pins. The second V-shaped sliding groove 215 is defined on an inner side surface of the second vertical guide rail. The plurality of the third roller pins 216 are rotatably disposed on a first side wall of the second V-shaped sliding groove 215. The plurality of the fourth roller pins are rotatably disposed on a second side wall of the second V-shaped sliding groove 215.

Correspondingly, a first V-shaped flange 217, slidable in the first V-shaped sliding groove 212, is disposed on a first side of the sliding block 205. A second V-shaped flange 218, slidable in the second V-shaped sliding groove 215, is disposed on a second side of the sliding block 205.

During up-down movement of the sliding block 205, the first V-shaped flange 217 and the second V-shaped flange 218 respectively slide in the first V-shaped sliding groove 212 and the second V-shaped sliding groove 215. Two side walls of the first V-shaped flange 217 and two side walls of the second V-shaped flange 218 respectively abut against the first roller pins 213, the second roller pins 214, the third roller pins 216, and the fourth roller pins. The sliding block is slid through rotating the first rolling roller pins 213, the second rolling roller pins 214, the third rolling roller pins 216, and the fourth rolling roller pins, which greatly reduces friction between the sliding block 205 and the first V-shaped sliding groove 212 with the second V-shaped sliding groove 215, reduces power loss, and further improves punching force and stability of the machine head.

Specifically, the plurality of the first roller pins 213 are disposed in parallel, the plurality of the second roller pins 214 are disposed in parallel, the plurality of the third roller pins 216 are disposed in parallel, and the plurality of the fourth roller pins are disposed in parallel.

It should be understood that in other embodiments, the first sliding rail 203 and the second sliding rail 204 may further be other sliding rails, as long as the sliding rails play a role of guiding the sliding block 205 to slide.

Specifically, as shown in FIGS. 3-4, the sliding block 205 includes a body, a first connecting portion 219, a second connecting portion 220, and a mounting position 221. The first connecting portion 219 is fixedly disposed on a first side of a bottom of the body and protrudes out of the bottom of the body. The second connecting portion 220 is fixedly disposed on a second side of the bottom of the body and protrudes out of the bottom of the body. The mounting position 221, configured to fix and install the punching component 206, is disposed between the first connecting portion 219 and the second connecting portion 220.

Furthermore, the punching component 206 includes a punching head component and a connecting component 222. The connecting component 222 connects the punching head component and the sliding block 205. A first vertical sliding groove 223 is defined on a first side of the connecting component 222, and the first connecting portion 219 is partially embedded in the first vertical sliding groove 223 and further slidably connected with the first vertical sliding groove 223. A second vertical sliding groove 224 is defined on a second side of the connecting component 222, and the second connecting portion 220 is partially embedded in the second vertical sliding groove 224 and further slidably connected with the second vertical sliding groove 224. A screw rod 225 is disposed on the body, the screw rod 225 vertically penetrates through the body and is screwed with the connecting component 222, and the screw rod 225 is rotated to drive the connecting component 222 to slide relative to the sliding block 205.

Furthermore, a nut 226 is fixedly disposed at a top end of the screw rod 225, and a polygonal hole is defined on the nut 226 or the nut 226 is a polygonal nut. A through hole 227 is defined on the body, and the screw rod 225 vertically penetrates through the through hole 227. A connecting hole 228 is defined on an outer side surface of the body, and the connecting hole 228 is communicated with the through hole 227. A crimping block 229 is disposed in the connecting hole 228, and the crimping block 229 is configured to compress the screw rod 225. The crimping block 229 is connected to the body through a bolt 230.

In the present embodiment, a threaded hole is defined on a top of the connecting component 222, and a bottom end of the screw rod 225 is screwed into the threaded hole.

When adjusting a height of the punching component, a nutsert is rotated to drive the screw rod 225 to rotate. Since both sides of the connecting component 222 are slidably connected to the first connecting portion 219 and the second connecting portion 220, in a rotating process of the screw rod 225, the screw rod 225 drives the connecting component 222 to slide along with the first connecting portion 219 and the second connecting portion 220, thereby achieving height adjustment of the connecting component 222 and the punching component.

Specifically, as shown in FIGS. 3-4, the punching head component at least includes a pressure sensor 231 and a first punching head 232. The pressure sensor 231 is fixedly disposed between the first punching head 232 and the connecting component 222. The first punching head 232 includes a fixing portion, a first clipping block 233, and a second clipping block 234. The first clipping block 233 is fixedly disposed on a first side of a bottom of the fixing portion. The second clipping block 234 is fixedly disposed on a second side of the bottom of the fixing portion. A first stop block 235 is disposed on a bottom end of the first clipping block 233, and the first stop block 235 extends in a direction of the second clipping block 234. A second stop block 236 is disposed on a bottom end of the second clipping block 234, and the second stop block 236 extends in a direction of the first clipping block 233. The first clipping block 233, the second clipping block 234, the first stop block 235, and the second stop block 236 are clipped to form a fixing position for mounting and fixing a mold.

When crimping the terminal, the mold is disposed on a fixing position between the first clipping block 233 and the second clipping block 234, and then the first punching head 232 is driven by the second driving motor 201 to crimp the terminal. Furthermore, by providing the pressure sensor 231, pressure data in the crimping process of the terminal is detected, which facilitates adjustment of the punching head 200.

Furthermore, the punching head component further includes a vertical crimping rod 240. The crimping rod 240 is fixedly connected to the connecting component 222, and the crimping rod 240 is connected to the connecting component 222 through a connecting rod 241. At least one fixing hole 242 is defined on the connecting rod 241, and the connecting rod 241 penetrates through the at least one fixing hole 242 and further fixedly connected with the at least one fixing hole 242.

The punching head component further includes a second punching head, and the second punching head is detachably connected to the first punching head 232. The second punching head includes a clipping block 237 and a connecting column 238. The clipping block 237 is fixedly clipped into the fixing position. The connecting column 238 is fixedly disposed on a middle of a bottom surface of the clipping block 237 and protrudes out of the bottom surface of the clipping block 237. At least one annular groove is defined on the connecting column 238 and is recessed inwards in the connecting column 238, or a connecting disc 239 is disposed on a surface of a bottom end of the connecting column 238.

In the embodiment, through providing the crimping rod 240, the crimping rod 240 moves along with the punching component during up-down movement of the punching component, so as to realize additional operation on wires. Furthermore, through providing the second crimping head, molds having different structures are fixed through the second crimping head.

Specifically, the supporting device 102 includes a first supporting plate 243 and a second supporting plate 244. The first supporting plate 243 and the second supporting plate 244 are fixedly connected to the machine table 101, and the first supporting plate 243 and the second supporting plate 244 are respectively disposed on two sides of the second driving motor 201. A fixing seat 245 is fixedly disposed between the first supporting plate 243 and the second supporting plate 244, and the fixing seat 245 is fixedly connected to the first supporting plate 243 and the second supporting plate 244. The first sliding rail 203 and the second sliding rail 204 are respectively disposed on two sides of the fixing seat 245, or the first sliding rail 203 and the second sliding rail 204 are respectively disposed on an inner side surface of the first supporting plate 243 and an inner side surface of the second supporting plate 244. The fixing seat 245 is disposed between the second right-angle speed reducer 202 and the sliding block 205. A fixing seat through hole 246 is defined on the fixing seat 245, and the turntable 207 rotates through the fixing seat through hole 246.

It should be understood that the first supporting plate 243 and the second supporting plate 244 are fixed to the machine table 101 to integrally support and fix the punching head 200.

In addition, in the present disclosure, terms such as "connected", "attached", "stacked", and the like should be understood broadly, for example, may be fixedly connected or detachably connected or integrated; may be directly connected or indirectly connected through an intermediate medium, or may be an interaction relationship between two or more elements inside the two elements. For a person with ordinary skill in art, specific meanings of the above terms in the present disclosure may be understood according to specific situations.

The above descriptions are merely embodiments of the present disclosure, and are not intended to limit patent scope of the present disclosure. Any equivalent structure or equivalent process transformation made through using the descriptions and drawings of the present disclosure, or directly or indirectly applied to other related technical fields, is intended to be included in the patent protection scope of the present disclosure.

What is claimed is:

1. A multi-station rotating terminal crimping machine head, comprising:

a machine table;

a supporting device;

a punching head;

a rotating seat;

a plurality of station seats;

a first driving motor; and a first right-angle speed reducer;

wherein the supporting device is fixedly disposed on the machine table, the punching head is disposed on the supporting device, the rotating seat is rotatably disposed on the machine table, the plurality of the station seats are disposed on the rotating seat and rotate along with the rotating seat the first driving motor and the first right-angle speed reducer are disposed on the machine table and the first driving motor and the first right-angle speed reducer are configured to drive the rotating seat to rotate; the plurality of the station seats are disposed at equal intervals on a periphery of the rotating seat, the multi-station rotating terminal crimping machine head further comprises an air cylinder, a telescopic positioning rod is disposed on the air cylinder; a plurality of positioning holes are defined on the rotating seat and the plurality of the positioning holes are configured for the telescopic positioning rod to be inserted into when the plurality of the station seats rotate to face the punching head;

wherein the machine table comprises a mounting table and a U-shaped supporting seat the U-shaped supporting seat is fixedly disposed at an end of the mounting table; the U-shaped supporting seat comprises a first supporting seat, a base, and a second supporting seat; wherein the first supporting seat is vertically and fixedly connected to an end of the mounting table, the base is vertically and fixedly connected to a bottom end of the first supporting seat, the second supporting seat is vertically and fixedly connected to a second end of the base; the rotating seat is rotatably disposed between the first supporting seat and the second supporting seat, the first driving motor and the first right-angle speed reducer are fixedly disposed on the first supporting seat, an output end of the first driving motor is connected to an input end of the first right-angle speed reducer, the first right-angle speed reducer drives the rotating seat to rotate, a first side of the rotating seat is fixedly connected with an output shaft of the first right-angle speed reducer, and a second side of the rotating seat is rotatably connected to the second supporting seat, the air cylinder is fixedly disposed on the first supporting seat.

2. The multi-station rotating terminal crimping machine head according to claim 1, wherein the punching head comprises a second driving motor, a second right-angle speed reducer, a first sliding rail, a second sliding rail, a sliding block, and a punching component; the second driving motor is fixedly disposed on the supporting device, the second right-angle speed reducer is connected to the second driving motor, the first sliding rail is fixedly disposed on the supporting device, the second sliding rail is fixedly disposed on the supporting device and is opposite to the first sliding rail, the sliding block is slidably disposed between the first sliding rail and the second sliding rail, the punching component is disposed at a bottom of the sliding block and moves along with the sliding block; an output end of the second driving motor is connected to an input end of the second right-angle speed reducer; a turntable is disposed on an output shaft of the second right-angle speed reducer, and the turntable rotates along with the output shaft of the second right-angle speed reducer; an eccentric shaft is eccentrically disposed on the turntable, a driving disc is rotatably sleeved on the eccentric shaft, a circular racetrack-shaped driving cavity for accommodating the driving disc is disposed on the sliding block, and the driving disc rotates in the circular racetrack-shaped driving cavity and drives the sliding block to slide along the first sliding rail and the second sliding rail.

3. The multi-station rotating terminal crimping machine head according to claim 2, wherein the first sliding rail comprises a first vertical guide rail, a first V-shaped sliding groove, a plurality of first roller pins, and a plurality of second roller pins; wherein the first V-shaped sliding groove is defined on an inner side surface of the first vertical guide rail, the plurality of the first roller pins are rotatably disposed on a first side wall of the first V-shaped sliding groove, and the plurality of the second roller pins are rotatably disposed on a second side wall of the first V-shaped sliding groove;

the second sliding rail comprises a second vertical guide rail, a second V-shaped sliding groove, a plurality of third roller pins, and a plurality of fourth roller pins; wherein the second V-shaped sliding groove is defined on an inner side surface of the second vertical guide rail, the plurality of the third roller pins are rotatably disposed on a first side wall of the second V-shaped sliding groove, and the plurality of the fourth roller pins are rotatably disposed on a second side wall of the second V-shaped sliding groove;

a first V-shaped flange, slidable in the first V-shaped sliding groove, is disposed on a first side of the sliding block; and a second V-shaped flange, slidable in the second V-shaped sliding groove, is disposed on a second side of the sliding block.

4. The multi-station rotating terminal crimping machine head according to claim 2, wherein the sliding block comprises a body, a first connecting portion, a second connecting portion and a mounting position; wherein the first connecting portion is fixedly disposed on a first side of a bottom of the body and protrudes out of a bottom of the body, the second connecting portion is fixedly disposed on a second side of the bottom of the body and protrudes out of the bottom of the body; and the mounting position is configured to fix and install the punching component and disposed between the first connecting portion and the second connecting portion.

5. The multi-station rotating terminal crimping machine head according to claim 4, wherein the punching component comprises a punching head component and a connecting component; the connecting component connects the punching head component with the sliding block, a first vertical sliding groove is defined on a first side of the connecting component, the first connecting portion is partially embedded in the first vertical sliding groove and further slidably connected with the first vertical sliding groove; a second vertical sliding groove is defined on a second side of the connecting component, the second connecting portion is partially embedded in the second vertical sliding groove and further slidably connected with the second vertical sliding groove; a screw rod is disposed on the body, the screw rod vertically penetrates through the body and is screwed with the connecting component, the screw rod is rotated to drive the connecting component to slide relative to the sliding block;

a nut is fixedly disposed at a top end of the screw rod, a polygonal hole is defined on the nut or the nut is a polygonal nut;

a through hole is defined on the body, the screw rod vertically penetrates through the through hole; a connecting hole is defined on an outer side surface of the body, and the connecting hole is communicated with the through hole; a crimping block is disposed in the connecting hole, the crimping block is configured to compress the screw rod; and the crimping block is connected to the body through a bolt.

6. The multi-station rotating terminal crimping machine head according to claim 5, wherein the punching head component at least comprises a pressure sensor and a first punching head, the pressure sensor is fixedly disposed between the first punching head and the connecting component; the first punching head comprises a fixing portion, a first clipping block, and a second clipping block; the first clipping block is fixedly disposed on a first side of a bottom of the fixing portion, the second clipping block is fixedly disposed on a second side of the bottom of the fixing portion; a first stop block is disposed on a bottom end of the first clipping block, and the first stop block extends in a direction of the second clipping block a second stop block is disposed on a bottom end of the second clipping block, the second stop block extends in a direction of the first clipping block; and the first clipping block, the second clipping block, the first stop block, and the second stop block are clipped to form a fixing position for mounting and fixing a mold.

7. The multi-station rotating terminal crimping machine head according to claim 6, wherein the punching head component further comprises a vertical crimping rod, the crimping rod is fixedly connected to the connecting component, the crimping rod is connected to the connecting component through a connecting rod; at least one fixing hole is defined on the connecting rod, and the crimping rod penetrates through the at least one fixing hole and is further fixedly connected with the at least one fixing hole;

the punching head component further comprises a second punching head, the second punching head is detachably connected to the first punching head; the second punching head comprises a clipping block and a connecting column, the clipping block is fixedly clipped into the fixing position, the connecting column is fixedly disposed on a middle of a bottom surface of the clipping block and protrudes out of the bottom surface of the clipping block; and at least one annular groove is defined on the connecting column and is recessed inwards in the connecting column, or a connecting disc is disposed on a surface of a bottom end of the connecting column.

8. The multi-station rotating terminal crimping machine head according to claim 2, wherein the supporting device comprises a first supporting plate and a second supporting plate, the first supporting plate and the second supporting plate are fixedly connected to the machine table, the first supporting plate and the second supporting plate are respectively disposed on two sides of the second driving motor; a fixing seat is fixedly disposed between the first supporting plate and the second supporting plate, the fixing seat is fixedly connected to the first supporting plate and the second supporting plate; the first sliding rail and the second sliding rail are respectively disposed on two sides of the fixing seat or the first sliding rail and the second sliding rail are respectively disposed on an inner side surface of the first supporting plate and an inner side surface of the second supporting plate; and the fixing seat is disposed between the second right-angle speed reducer and the sliding block and a fixing seat through hole is defined on the fixing seat and the turntable rotates through the fixing seat through hole.

9. A multi-station rotating terminal crimping machine head, comprising:

a machine table;

a supporting device;

a punching head;

a rotating seat;

a plurality of station seats;

a first driving motor; and a first right-angle speed reducer;

wherein the supporting device is fixedly disposed on the machine table, the punching head is disposed on the supporting device, the rotating seat is rotatably disposed on the machine table, the plurality of the station seats are disposed on the rotating seat and rotate along with the rotating seat, the first driving motor and the first right-angle speed reducer are disposed on the machine table and the first driving motor and the first right-angle speed reducer are configured to drive the rotating seat to rotate; the plurality of the station seats are disposed at equal intervals on a periphery of the rotating seat, the multi-station rotating terminal crimping machine head further comprises an air cylinder, a telescopic positioning rod is disposed on the air cylinder; a plurality of positioning holes are defined on the rotating seat, and the plurality of the positioning holes are configured for the telescopic positioning rod to be inserted into when the plurality of the station seats rotate to face the punching head;

wherein the punching head comprises a second driving motor, a second right-angle speed reducer, a first sliding rail, a second sliding rail, a sliding block, and a punching component; the second driving motor is fixedly disposed on the supporting device, the second right-angle speed reducer is connected to the second driving motor, the first sliding rail is fixedly disposed on the supporting device, the second sliding rail is fixedly disposed on the supporting device and is opposite to the first sliding rail, the sliding block is slidably disposed between the first sliding rail and the second sliding rail, the punching component is disposed at a bottom of the sliding block and moves along with the sliding block; an output end of the second driving motor is connected to an input end of the second right-angle speed reducer; a turntable is disposed on an output shaft of the second right-angle speed reducer, and the turntable rotates along with the output shaft of the second right-angle speed reducer; an eccentric shaft is eccentrically disposed on the turntable, a driving disc is rotatably sleeved on the eccentric shaft, a circular racetrack-shaped driving cavity for accommodating the driving disc is disposed on the sliding block, and the driving disc rotates in the circular racetrack-shaped driving cavity and drives the sliding block to slide along the first sliding rail and the second sliding rail.

10. The multi-station rotating terminal crimping machine head according to claim 9, wherein the first sliding rail comprises a first vertical guide rail, a first V-shaped sliding groove, a plurality of first roller pins, and a plurality of second roller pins; wherein the first V-shaped sliding groove is defined on an inner side surface of the first vertical guide rail, the plurality of the first roller pins are rotatably disposed on a first side wall of the first V-shaped sliding groove, and the plurality of the second roller pins are rotatably disposed on a second side wall of the first V-shaped sliding groove;

the second sliding rail comprises a second vertical guide rail, a second V-shaped sliding groove, a plurality of third roller pins, and a plurality of fourth roller pins; wherein the second V-shaped sliding groove is defined on an inner side surface of the second vertical guide rail, the plurality of the third roller pins are rotatably disposed on a first side wall of the second V-shaped sliding groove, and the plurality of the fourth roller pins are rotatably disposed on a second side wall of the second V-shaped sliding groove;

a first V-shaped flange, slidable in the first V-shaped sliding groove, is disposed on a first side of the sliding block; and a second V-shaped flange, slidable in the second V-shaped sliding groove, is disposed on a second side of the sliding block.

11. The multi-station rotating terminal crimping machine head according to claim 9, wherein the sliding block comprises a body, a first connecting portion, a second connecting portion, and a mounting position; wherein the first connecting portion is fixedly disposed on a first side of a bottom of the body and protrudes out of a bottom of the body, the second connecting portion is fixedly disposed on a second side of the bottom of the body and protrudes out of the bottom of the body; and the mounting position is configured to fix and install the punching component and disposed between the first connecting portion and the second connecting portion.

12. The multi-station rotating terminal crimping machine head according to claim 11, wherein the punching component comprises a punching head component and a connecting component; the connecting component connects the punching head component with the sliding block, a first vertical sliding groove is defined on a first side of the connecting component, the first connecting portion is partially embedded in the first vertical sliding groove and further slidably connected with the first vertical sliding groove; a second vertical sliding groove is defined on a second side of the connecting component, the second connecting portion is partially embedded in the second vertical sliding groove and further slidably connected with the second vertical sliding groove; a screw rod is disposed on the body, the screw rod vertically penetrates through the body and is screwed with the connecting component, the screw rod is rotated to drive the connecting component to slide relative to the sliding block;

a nut is fixedly disposed at a top end of the screw rod, a polygonal hole is defined on the nut or the nut is a polygonal nut;

a through hole is defined on the body, the screw rod vertically penetrates through the through hole; a connecting hole is defined on an outer side surface of the body, and the connecting hole is communicated with the through hole; a crimping block is disposed in the connecting hole, the crimping block is configured to compress the screw rod; and the crimping block is connected to the body through a bolt.

13. The multi-station rotating terminal crimping machine head according to claim 12, wherein the punching head component at least comprises a pressure sensor and a first punching head, the pressure sensor is fixedly disposed between the first punching head and the connecting component; the first punching head comprises a fixing portion, a first clipping block, and a second clipping block; the first clipping block is fixedly disposed on a first side of a bottom of the fixing portion, the second clipping block is fixedly disposed on a second side of the bottom of the fixing portion; a first stop block is disposed on a bottom end of the first clipping block, and the first stop block extends in a direction of the second clipping block; a second stop block is disposed on a bottom end of the second clipping block, the second stop block extends in a direction of the first clipping block; and the first clipping block, the second clipping block, the first stop block, and the second stop block are clipped to form a fixing position for mounting and fixing a mold.

14. The multi-station rotating terminal crimping machine head according to claim 13, wherein the punching head component further comprises a vertical crimping rod, the crimping rod is fixedly connected to the connecting component, the crimping rod is connected to the connecting component through a connecting rod; at least one fixing hole is defined on the connecting rod, and the crimping rod penetrates through the at least one fixing hole and is further fixedly connected with the at least one fixing hole;

the punching head component further comprises a second punching head, the second punching head is detachably connected to the first punching head; the second punching head comprises a clipping block and a connecting column, the clipping block is fixedly clipped into the fixing position, the connecting column is fixedly disposed on a middle of a bottom surface of the clipping block and protrudes out of the bottom surface of the clipping block; and at least one annular groove is defined on the connecting column and is recessed inwards in the connecting column, or a connecting disc is disposed on a surface of a bottom end of the connecting column.

15. The multi-station rotating terminal crimping machine head according to claim 9, wherein the supporting device comprises a first supporting plate and a second supporting plate, the first supporting plate and the second supporting plate are fixedly connected to the machine table, the first supporting plate and the second supporting plate are respectively disposed on two sides of the second driving motor; a fixing seat is fixedly disposed between the first supporting plate and the second supporting plate, the fixing seat is fixedly connected to the first supporting plate and the second supporting plate; the first sliding rail and the second sliding rail are respectively disposed on two sides of the fixing seat or the first sliding rail and the second sliding rail are respectively disposed on an inner side surface of the first supporting plate and an inner side surface of the second supporting plate; and the fixing seat is disposed between the second right-angle speed reducer and the sliding block; and a fixing seat through hole is defined on the fixing seat and the turntable rotates through the fixing seat through hole.

* * * * *